US011310600B2

(12) United States Patent
Naderyan et al.

(10) Patent No.: US 11,310,600 B2
(45) Date of Patent: Apr. 19, 2022

(54) ACOUSTIC TRANSDUCER WITH REDUCED DAMPING

(71) Applicant: Knowles Electronics, LLC, Itasca, IL (US)

(72) Inventors: Vahid Naderyan, Chicago, IL (US); Sung Bok Lee, Chicago, IL (US); Michael Kuntzman, Chicago, IL (US)

(73) Assignee: KNOWLES ELECTRONICS, LLC, Itasca, IL (US)

( * ) Notice: Subject to any disclaimer, the term of this patent is extended or adjusted under 35 U.S.C. 154(b) by 0 days.

(21) Appl. No.: 17/274,143

(22) PCT Filed: Nov. 8, 2019

(86) PCT No.: PCT/US2019/060561
§ 371 (c)(1),
(2) Date: Mar. 5, 2021

(87) PCT Pub. No.: WO2020/097524
PCT Pub. Date: May 14, 2020

(65) Prior Publication Data

US 2021/0274287 A1 Sep. 2, 2021

Related U.S. Application Data

(60) Provisional application No. 62/757,983, filed on Nov. 9, 2018.

(51) Int. Cl.
*H04R 7/26* (2006.01)
*H04R 7/04* (2006.01)
(Continued)

(52) U.S. Cl.
CPC ..... *H04R 7/26* (2013.01); *H04R 7/04* (2013.01); *H04R 19/04* (2013.01); *H04R 1/04* (2013.01); *H04R 2201/003* (2013.01)

(58) Field of Classification Search
CPC ... H04R 1/04; H04R 7/02; H04R 7/04; H04R 19/04; H04R 2201/003; B81B 3/0021; B81B 7/02
See application file for complete search history.

(56) References Cited

U.S. PATENT DOCUMENTS

2015/0014797 A1* 1/2015 Schelling ..... B81C 1/00158 257/416
2017/0230757 A1 8/2017 Kuntzman et al.
(Continued)

FOREIGN PATENT DOCUMENTS

EP 2207364 A1 7/2010
JP 2008005439 A 1/2008

OTHER PUBLICATIONS

International Search Report, PCTUS2019/060561, Date of the actual completion of the international search Apr. 8, 2020.
(Continued)

*Primary Examiner* — Sunita Joshi
(74) *Attorney, Agent, or Firm* — Flener IP & Business Law; Zareefa B. Flener

(57) ABSTRACT

An acoustic transducer for generating electrical signals in response to acoustic signals includes a transducer substrate, a back plate, and a diaphragm assembly. The diaphragm assembly includes a first diaphragm and a second diaphragm coupled thereto. The second diaphragm is positioned closer to the back plate than the first diaphragm. The second diaphragm includes a plurality of diaphragm apertures configured to allow air to pass through the second diaphragm. Each of the back plate and the first diaphragm are coupled to the transducer substrate at their periphery. In an embodiment, the transducer includes a post coupled to the first diaphragm and the second diaphragm, the post configured to prevent movement of the second diaphragm relative to the
(Continued)

first diaphragm in a direction substantially perpendicular to the second diaphragm.

16 Claims, 15 Drawing Sheets

(51) Int. Cl.
*H04R 19/04* (2006.01)
*H04R 1/04* (2006.01)

(56) References Cited

U.S. PATENT DOCUMENTS

| | | | | |
|---|---|---|---|---|
| 2017/0260040 | A1* | 9/2017 | Walther | H04R 19/04 |
| 2018/0099867 | A1 | 4/2018 | Walther et al. | |
| 2018/0115836 | A1 | 4/2018 | Hsieh et al. | |

OTHER PUBLICATIONS

PCT Written Opinion of the International Searching Authority, International application No. PCT/US2019/060561, dated Apr. 8, 2020.

* cited by examiner

ACOUSTIC TRANSDUCER WITH REDUCED DAMPING

CROSS REFERENCE TO RELATED APPLICATIONS

The present application claims the benefit of and priority to U.S. Provisional Application No. 62/757,983, filed Nov. 9, 2018, entitled "Acoustic Transducer with Reduced Damping," the disclosure of which is incorporated herein by reference in its entirety.

BACKGROUND

The present disclosure relates generally to acoustic transducers, particularly microelectromechanical system (MEMS) transducers. MEMS transducers include a perforated back plate and an unperforated diaphragm, which move relative to one another in response to incident sound energy to generate an electrical signal. The electrical signal corresponds to a change in electrical capacitance between the diaphragm and the back plate. One of the major sources of noise in the electrical signal, generated by MEMS transducers, is associated with squeeze film damping (SFD) (referred to hereinafter as damping) in the space between the diaphragm and the back plate. The amount of noise is typically proportional to the amount of damping between the diaphragm and the back plate. In MEMS transducers, there exists a need to reduce the noise associated with damping, and thereby increase the signal-to-noise ratio (SNR) of MEMS transducers.

SUMMARY

A first aspect of the present disclosure relates to an acoustic transducer for generating electrical signals in response to acoustic signals. The acoustic transducer includes a back plate defining a plurality of apertures and a diaphragm assembly. The diaphragm assembly includes a pair of diaphragms, a first diaphragm and a second diaphragm coupled thereto. Each one of the pair of diaphragms is oriented substantially parallel to the back plate. The first diaphragm is offset from the back plate such that a cavity is formed between the first diaphragm and the back plate. The second diaphragm is positioned closer to the back plate than the first diaphragm. The second diaphragm defines a plurality of diaphragm apertures.

A second aspect of the present disclosure also relates to an acoustic transducer for generating electrical signals in response to acoustic signals. The acoustic transducer includes a pair of back plates, a first back plate arranged substantially parallel to a second back plate. The first back plate is offset from the second back plate such that a cavity is formed therebetween. The first back plate defines a first plurality of apertures and the second back plate defines a second plurality of apertures. The acoustic transducer includes a diaphragm assembly including a pair of diaphragms, a first diaphragm and a second diaphragm coupled thereto. Each of the diaphragms is oriented substantially parallel to the first back plate. The second diaphragm of the pair of diaphragms is disposed in the cavity formed between the first back plate and the second back plate. The second diaphragm defines a plurality of diaphragm apertures.

The foregoing summary is illustrative only and is not intended to be in any way limiting. In addition to the illustrative aspects, embodiments, and features described above, further aspects, embodiments, and features will become apparent by reference to the following drawings and the detailed description.

BRIEF DESCRIPTION OF THE DRAWINGS

The foregoing and other features of the present disclosure will become more fully apparent from the following description and appended claims, taken in conjunction with the accompanying drawings. These drawings depict only several embodiments in accordance with the disclosure and are, therefore, not to be considered limiting of its scope. Various embodiments are described in more detail below in connection with the appended drawings.

Figure 1:
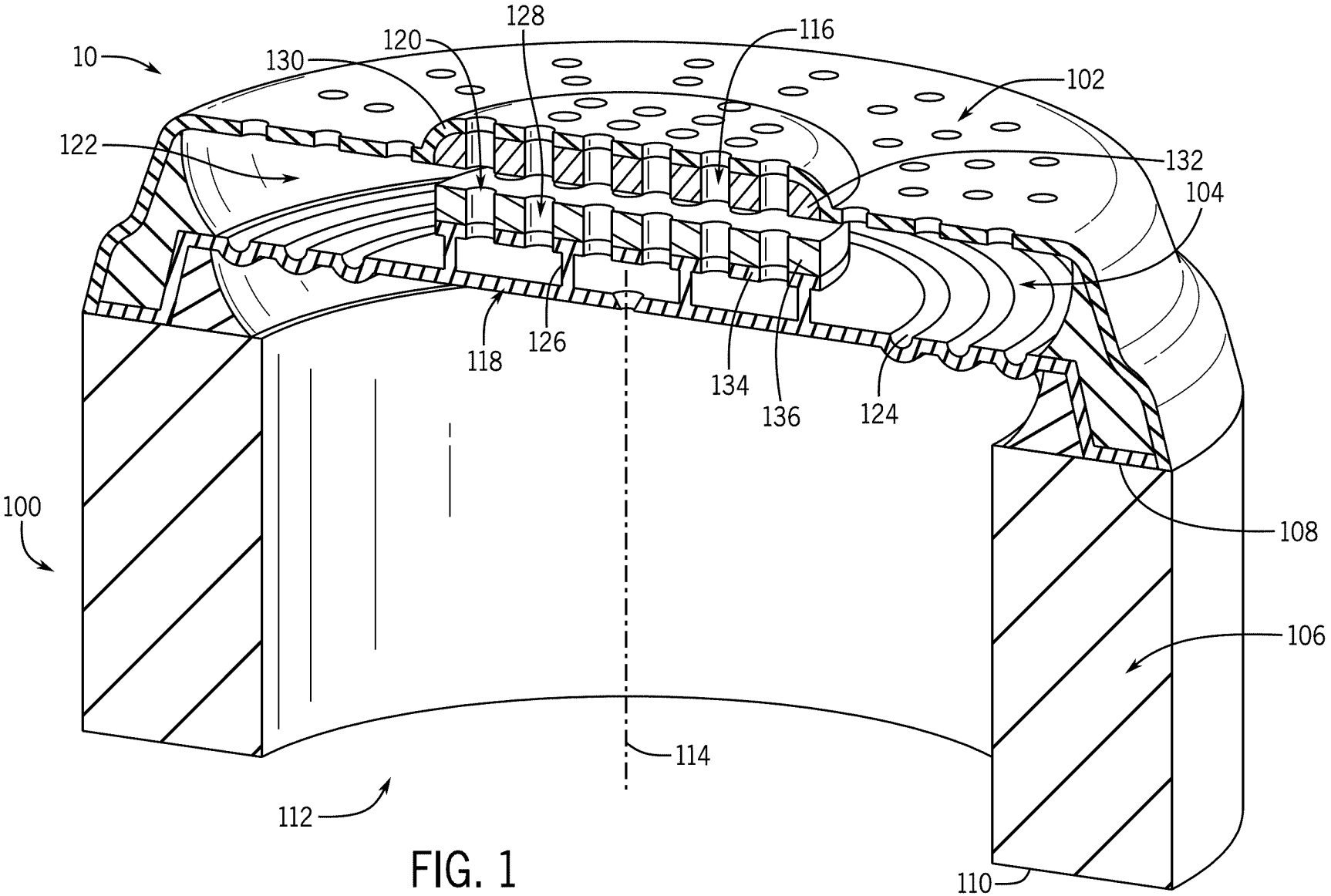
FIG. 1 is a perspective cross-sectional view of an acoustic transducer, according to an illustrative embodiment.

In the following detailed description, various embodiments are described with reference to the appended drawings. The skilled person will understand that the accompanying drawings are schematic and simplified for clarity and therefore merely show details which are essential to the understanding of the disclosure, while other details have been left out. Like reference numerals refer to like elements or components throughout. Like elements or components will therefore not necessarily be described in detail with respect to each figure.

DETAILED DESCRIPTION

In general, disclosed herein are devices and systems for reducing noise in an electrical signal generated by an acoustic transducer. In some embodiments, the acoustic transducer includes a back plate defining a plurality of apertures and a diaphragm assembly. The diaphragm assembly includes a pair of diaphragms including a first diaphragm and a second diaphragm, each diaphragm oriented substantially parallel to the back plate. Each of the diaphragms is each offset (e.g., spaced apart) from the back plate. The first diaphragm is offset farther from the back plate than the second diaphragm, so as to reduce damping between the first diaphragm and the back plate as compared to transducers including only a single, unperforated diaphragm. The second diaphragm includes a plurality of diaphragm apertures configured to allow air to pass through the second diaphragm and thereby reduce air damping associated with movement of the second diaphragm relative to the back plate. Advantageously, using a diaphragm assembly rather than a single, unperforated diaphragm (e.g., a single diaphragm offset from the back plate, such as by a distance approximately equal to a distance between the second diaphragm and the back plate) provides a significant reduction to overall damping.

In one aspect, the acoustic transducer is configured to produce an electrical signal based on the movement of the second diaphragm relative to the back plate. The acoustic transducer may include a transducer substrate including a first end and a second end. Both the first diaphragm and the back plate may be coupled to the transducer substrate at their periphery. The first diaphragm is coupled to the second diaphragm so as to coordinate movement between the first and second diaphragms. The first and second diaphragms may be coupled using a plurality of posts extending between the diaphragms, in which case movement of the second diaphragm in a direction normal to the surface of the second diaphragm is transferred directly to the first diaphragm. In other embodiments, the second diaphragm is additionally coupled to a transducer substrate at a periphery of the second diaphragm, so as to provide additional support to the second diaphragm and/or change the stiffness of the second diaphragm. The details of the general depiction provided above will be more fully explained by reference to FIGS. 1-22.

Figure 2:
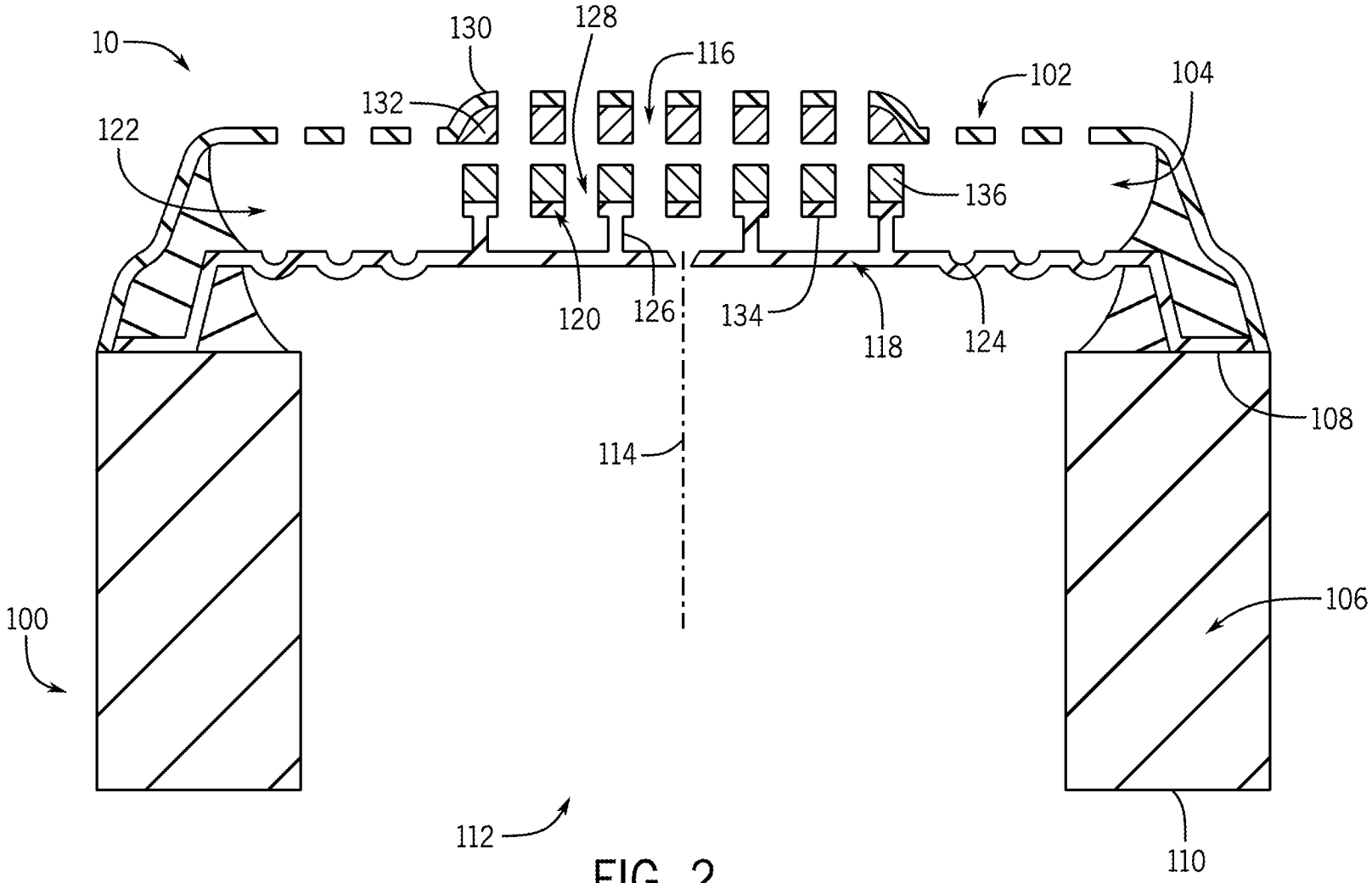
FIG. 2 is a side cross-sectional view of the acoustic transducer of FIG. 1.

FIGS. 1-2 show an acoustic transducer, shown as transducer 10, according to an illustrative embodiment. In the embodiment of FIG. 1, the transducer 10 is configured as a microelectromechanical system (MEMS) transducer configured to generate an electrical signal in response to acoustic disturbances incident on the transducer 10. The transducer 10 includes a transducer substrate 100, a back plate 102, and a diaphragm assembly 104. The transducer substrate 100 includes a substantially cylindrical support wall 106 including a first end 108 and a second end 110. An aperture 112 is disposed centrally through the support wall 106 and extends substantially parallel to a central axis 114 of the support wall 106, from the first end 108 of the support wall 106 to the second end 110 of the support wall 106. The aperture 112 is configured to carry (e.g., transmit, etc.) sound energy to other parts of the transducer 10, so as to allow sound energy to be incident on the diaphragm assembly 104 or back plate 102.

In the embodiment of FIGS. 1-2, the back plate 102 and the diaphragm assembly 104 each include conductive layers. Sound energy (e.g., sound waves, acoustic disturbances, etc.) incident on the diaphragm assembly 104 causes the diaphragm assembly 104 to move toward or away from the back plate 102. This results in a change in the distance between the two conductive layers. This change in the distance between the conductive layers results in a corresponding change in capacitance. An electrical signal representative of this change in capacitance can be generated and transmitted to other portions of a microphone device, such as an integrated circuit, for processing.

In the embodiment of FIGS. 1-2, both the back plate 102 and the diaphragm assembly 104 are disposed proximate to the first end 108 of the support wall 106. The back plate 102 is coupled to the support wall 106 at a periphery (e.g., outer perimeter, etc.) of the support wall 106. In an embodiment, the back plate 102 is coupled to a first end 108 of the support wall 106 proximate to an outer perimeter of the end 108. The back plate 102 defines a plurality of apertures 116 (e.g., perforations, etc.) extending through the back plate 102 in a direction substantially normal to the back plate 102 (e.g., in a direction substantially parallel to the central axis 114 of the support wall 106, etc.). Each one of the plurality of apertures 116 is configured to allow air to pass through the back plate 102, from a first side of the back plate 102 to a second side of the back plate 102. In an embodiment, the number, shape, and size of each one of the plurality of apertures 116 is selected such that the back plate 102 does not substantially restrict the movement of air.

As shown in FIGS. 1-2, the diaphragm assembly 104 includes a first diaphragm 118 and a second diaphragm 120 coupled thereto. Each diaphragm 118, 120 is oriented substantially parallel to the back plate 102 and is offset (spaced apart, etc.) from the back plate 102. A distance between the second diaphragm 120 and the back plate 102 is less than a distance between the first diaphragm 118 and the back plate 102. In the embodiment of FIGS. 1-2, the second diaphragm 120 is disposed in a cavity 122 formed between the first diaphragm 118 and the back plate 102, so as to shield the first diaphragm 118 from the back plate 102. In other embodiments, the second diaphragm 120 is disposed on an opposite side of the back plate 102 as the first diaphragm 118.

In the embodiment of FIGS. 1-2, the first diaphragm 118 is coupled to the support wall 106 at a periphery of the first diaphragm 118. Similar to the back plate 102, the first diaphragm 118 is coupled to the first end 108 of the support wall 106 at a periphery of the first diaphragm 118. As shown in FIGS. 1-2, the first diaphragm 118 is coupled to the first end 108 between an outer perimeter of the first end 108 and an inner perimeter of the first end 108. In other embodiments, the first diaphragm 118 is coupled to the inner surface of the support wall 106 defining the aperture 112. In yet other embodiments, the first diaphragm 118 is coupled to a different portion of the transducer substrate 100 (e.g., a second support wall extending into the aperture 112, etc.), or is otherwise suspended proximate to the back plate 102. In the embodiment of FIGS. 1-2, the first diaphragm 118 includes a plurality of substantially U-shaped corrugations 124 extending circumferentially around the first diaphragm 118, proximate to an outer perimeter of the first diaphragm 118. Among other benefits, each of the plurality of corrugations 124 facilitates movement of the diaphragm assembly 104 relative to the back plate 102 (e.g., in a direction substantially perpendicular to the back plate 102, etc.). In other embodiments, a cross-sectional geometry or surface arrangement of one or more corrugations 124 may be different (e.g., the corrugations may be arranged as concentric polygonal or elliptical shaped depressions in the surface of the first diaphragm 118 when viewed from the top of the first diaphragm 118, etc.).

In the embodiment of FIGS. 1-2, the second diaphragm 120 is disposed in the cavity 122 between the first diaphragm 118 and the back plate 102. The second diaphragm 120 is coupled to the first diaphragm 118 to limit movement of the second diaphragm 120 relative to the first diaphragm 118. In the embodiment of FIGS. 1-2, the first diaphragm 118 is coupled to the second diaphragm 120 so as to coordinate (e.g., link, etc.) movement of the diaphragms 118, 120 in a direction substantially normal to the diaphragms 118, 120 (e.g., in a substantially vertical direction, in a direction substantially parallel to the central axis 114 of the transducer substrate 100, toward and away from the back plate 102, etc.).

In the embodiment of FIGS. 1-2, the diaphragm assembly 104 includes a plurality of support members, shown as posts 126, configured to couple the first diaphragm 118 to the second diaphragm 120. Each of the posts 126 extends between the first diaphragm 118 and the second diaphragm 120 in a direction substantially perpendicular to diaphragms 118, 120. A first end of each post 126 is coupled to the first diaphragm 118, while a second end of each post 126 is coupled to the second diaphragm 120. A variety of different geometries may be utilized for each of the posts 126. In the embodiment of FIGS. 1-2, each post 126 is configured as a substantially cylindrical rod/shaft. In other embodiments, one or more posts 126 may be at least partially hollow. For example, each post 126 may be configured as an inverted truncated cone formed into one of the first diaphragm 118 and the second diaphragm 120. In other embodiments, each post 126 may be formed as a substantially hollow member with a square or rectangular cross-section, rounded S-shaped side walls or any other suitable shape. In the embodiment of FIGS. 1-2, a thickness of each post 126 and a number of posts are sufficient to prevent movement of the second diaphragm 120 relative to the first diaphragm 118 in a direction substantially perpendicular to the second diaphragm 120 (e.g., toward and away from the back plate 102, etc.).

The diaphragm assembly 104 is configured to reduce damping associated with movement of the diaphragms 118, 120 relative to the back plate 102. The second diaphragm 120 is configured to move toward the back plate 102 and away from the back plate 102 (e.g., substantially perpendicular to the back plate 102, etc.) in response to sound energy incident on the second diaphragm 120. The second diaphragm 120 includes a plurality of diaphragm apertures 128 (e.g., perforations, etc.) extending through second diaphragm 120 to allow air to pass through the second diaphragm 120, which, advantageously, reduces damping between the second diaphragm 120 and the back plate 102. Each of the plurality of diaphragm apertures 128 is oriented substantially perpendicular to the second diaphragm 120 (e.g., substantially parallel to the central axis 114, etc.). The number, geometry, and arrangement of the plurality of diaphragm apertures 128 may vary depending on the desired performance of the transducer 10. In the embodiment of FIGS. 1-2, each of the plurality of diaphragm apertures 128 is a hole whose diameter is substantially similar to the diameter of each of the plurality of apertures 116 in the back plate 102. Additionally, a pitch or distance between adjacent ones of the apertures 116, 128 in the back plate 102 and the second diaphragm 120 (e.g., a distance between a primary axis of two adjacent apertures 116, 128) are approximately equal, in some embodiments.

As shown in FIG. 2, each of the plurality of diaphragm apertures 128 is aligned with a corresponding one of the plurality of apertures 116 in the back plate 102. In other embodiments, the plurality of diaphragm apertures 128 is misaligned with the plurality of apertures 116 in the back plate 102, such that each of the plurality of apertures 116 in the back plate 102 is at least partially occluded by the second diaphragm 120 in a direction substantially perpendicular to the back plate 102. Among other benefits, misaligning the apertures 116, 128 may reduce a horizontal component of damping between the diaphragms 118, 120 and the back plate 102.

The second diaphragm 120 is configured to move relative to the back plate 102 in response to sound energy incident on the second diaphragm 120 so as to generate a change in capacitance. In the embodiment of FIGS. 1-2, the back plate 102 includes an insulating layer 130 and a conductive layer 132 disposed thereon. Similarly, the second diaphragm 120 includes an insulating layer 134 and a conductive layer 136 disposed thereon. The insulating layer 130, 134 for each of the back plate 102 and the second diaphragm 120 may be made from silicon nitride or another suitable insulating material. The conductive layer 132, 136 for the back plate 102 and the second diaphragm 120 may be made from polycrystalline silicon, a metal, or another suitable conductor. In the embodiment of FIGS. 1-2, the conductively layers 132, 136 for each of the back plate 102 and the second diaphragm 120 are shaped as thin cylindrical disks that are coaxial with one another.

As shown in FIGS. 1-2, the second diaphragm 120 is arranged in a manner such that the conductive layer 136 faces the back plate 102, while the insulating layer 134 faces toward the second end 110 of the support wall 106. The back plate 102 is arranged such that the conductive layer 132 faces the conductive layer 136 of the second diaphragm 120, while the insulating layer 130 faces away from the second diaphragm 120 (e.g., the conductive layer 132 of the back plate 102 is disposed in between the insulating layer 130 of the back plate 102 and the insulating layer 134 of the second diaphragm 120). The arrangement of insulating layers 130, 134 and conductive layers 132, 136 of the back plate 102 and the second diaphragm 120 is provided for illustrative purposes only. Many alternative geometries, arrangements, and materials may be used for the insulating layers 130, 134 and the conductive layers 136 without departing from the inventive principles disclosed herein. For example, the second diaphragm 120 may be reconfigured such that the insulating layer 134 faces toward the back plate 102, while the conductive layer 136 faces toward the second end of the support wall 106. Similarly, a diameter of the conductive layers 132, 136 may increase such that the conductive layers 132, 136 extend farther toward an outer perimeter of the back plate 102 and second diaphragm 120.

An electrical capacitance is associated with a distance between the conductive layer 132 of the back plate 102 and the conductive layer 136 of the second diaphragm 120. In the embodiment of FIGS. 1-2, the conductive layer 132 of the back plate 102 is electrically coupled to a first voltage potential by a conductive trace (e.g., ribbon, wire, etc.) disposed on the back plate 102. The conductive layer 136 of the second diaphragm 120 is electrically coupled to a second voltage potential by a conductive trace (e.g., ribbon, wire, etc.) disposed in the first diaphragm 118 (e.g., a conductive trace extending substantially radially along the first diaphragm 118 and along one of the plurality of posts 126 to the conductive layer 136 of the second diaphragm 120, etc.). The change in the distance between the conductive layers results in a change in the capacitance, which, in turn, results in a change in the amplitude of the electrical signal generated by the transducer 10.

Figure 3:
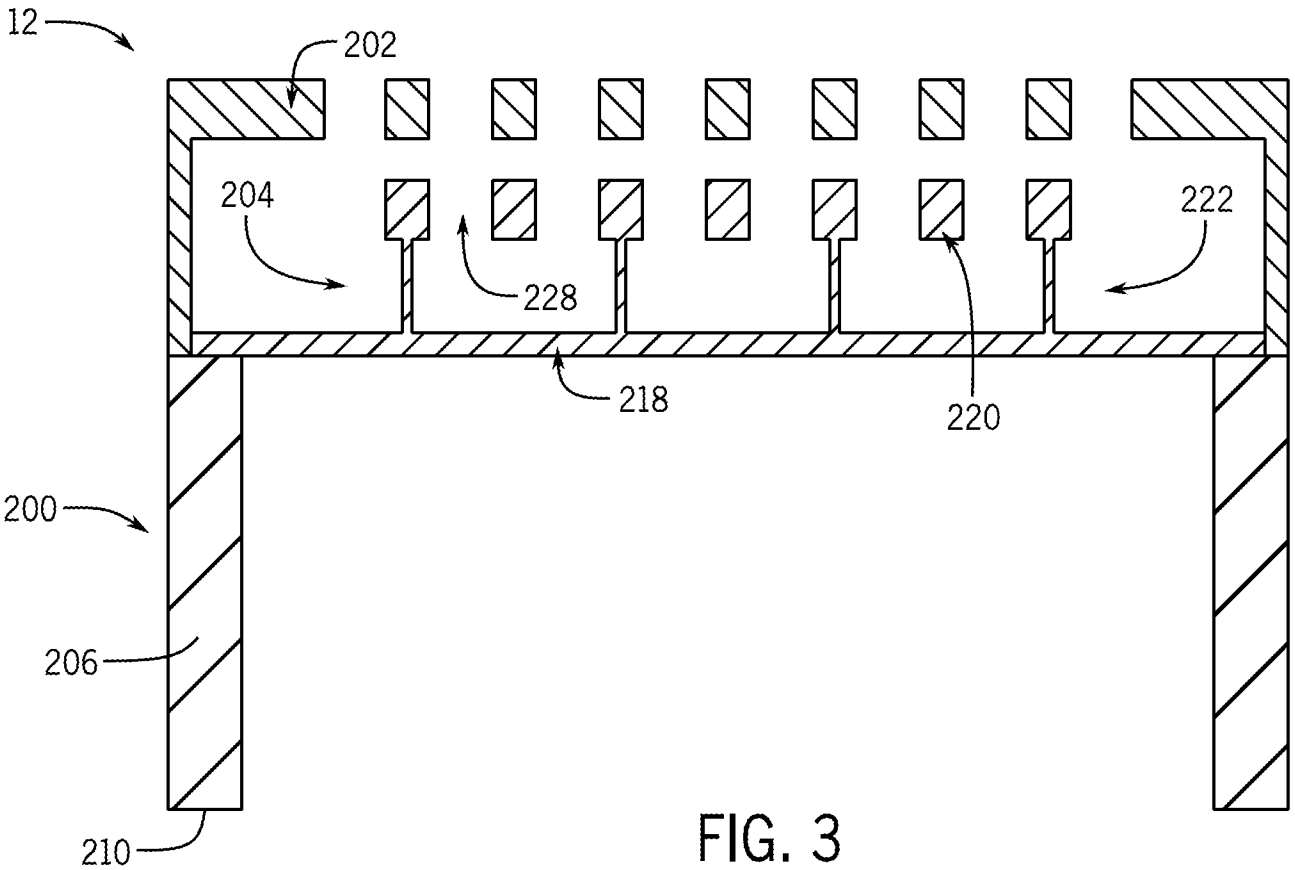
FIG. 3 is a conceptual representation of an acoustic transducer that is similar to the transducer of FIG. 1, according to an illustrative embodiment.

FIG. 3 shows a transducer 12 including a diaphragm assembly 204 and a back plate 202 in a configuration that is the same or substantially similar to the arrangement of FIGS. 1-2. The transducer 12 includes a transducer substrate 200 including a substantially cylindrical support wall 206. The diaphragm assembly 204 is disposed between the back plate 102 and a second end 210 of the support wall 206. The second diaphragm 220 is disposed in a cavity 222 formed between the first diaphragm 218 and the back plate 202. In the embodiment of FIG. 3, a thickness of the back plate 202 is approximately equal to a thickness of each of the first diaphragm 218 and second diaphragm 120. In an embodiment, the thickness of the back plate 202 and diaphragms 218, 220 is within a range between 0.5 microns and 3.5 microns. In other embodiments, the thickness of the back plate 202 and diaphragms 218, 220 is approximately 2 microns. In yet other embodiments, the thickness of one, or more of the back plate 202, the first diaphragm 218, and the second diaphragm 220 is different.

Figure 4:
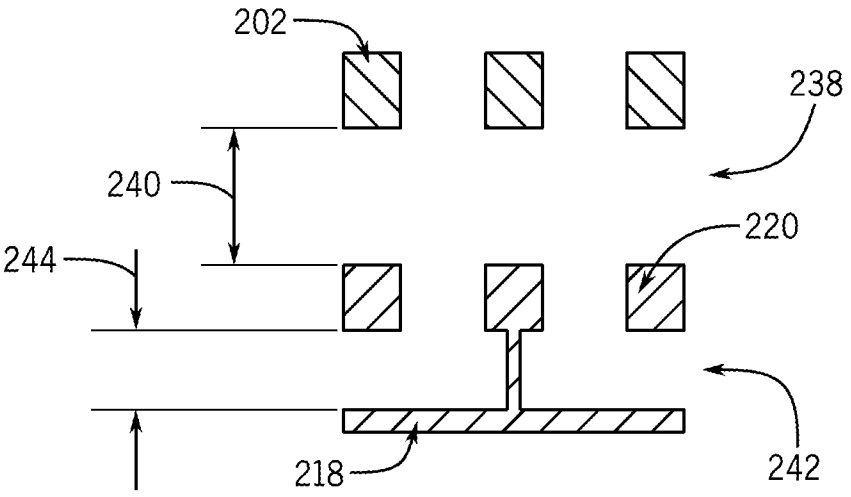
FIG. 4 is a partial view of the conceptual representation of FIG. 3, according to an illustrative embodiment.

As shown in FIG. 4, the second diaphragm 220 is positioned closer to the back plate 102 than the first diaphragm 218. The transducer 12 includes two gaps, a first gap 238 defined by a first distance 240 between the back plate 202 and the second diaphragm 220, and a second gap 242 defined by a second distance 244 between the first diaphragm 218 and the second diaphragm 220. As will be further described, the overall damping of the transducer 12 is a function of both the first and second distances 240, 244. In the embodiment of FIG. 4, the first distance 240 between the back plate 102 and the second diaphragm 220 is approximately two times the second distance 244 between the first diaphragm 218 and the second diaphragm 220, although other relative distances may be optimal in different applications. In an embodiment, the first distance 240 is approximately 4 microns and the second distance 244 is approximately 2 microns.

The overall damping performance of the transducer 12, in part, is a function of the size of the gaps between the diaphragms 218, 220 and the back plate 202. FIGS. 5-8 highlight some of the performance tradeoffs associated with different geometries of the transducer 12 (e.g., dual-diaphragm transducer) as compared with a MEMS transducer including a single, unperforated diaphragm 50. For the purposes of comparison, the geometry of the back plate 202 of both transducers in the simulations used to generate FIGS. 5-8 are set equal to one another. Additionally, the first distance 240 between the second diaphragm 220 and the back plate 202 of the dual-diaphragm transducer 12 is set equal to a gap distance between the unperforated diaphragm and the back plate of single diaphragm transducer 50.

Figure 5:
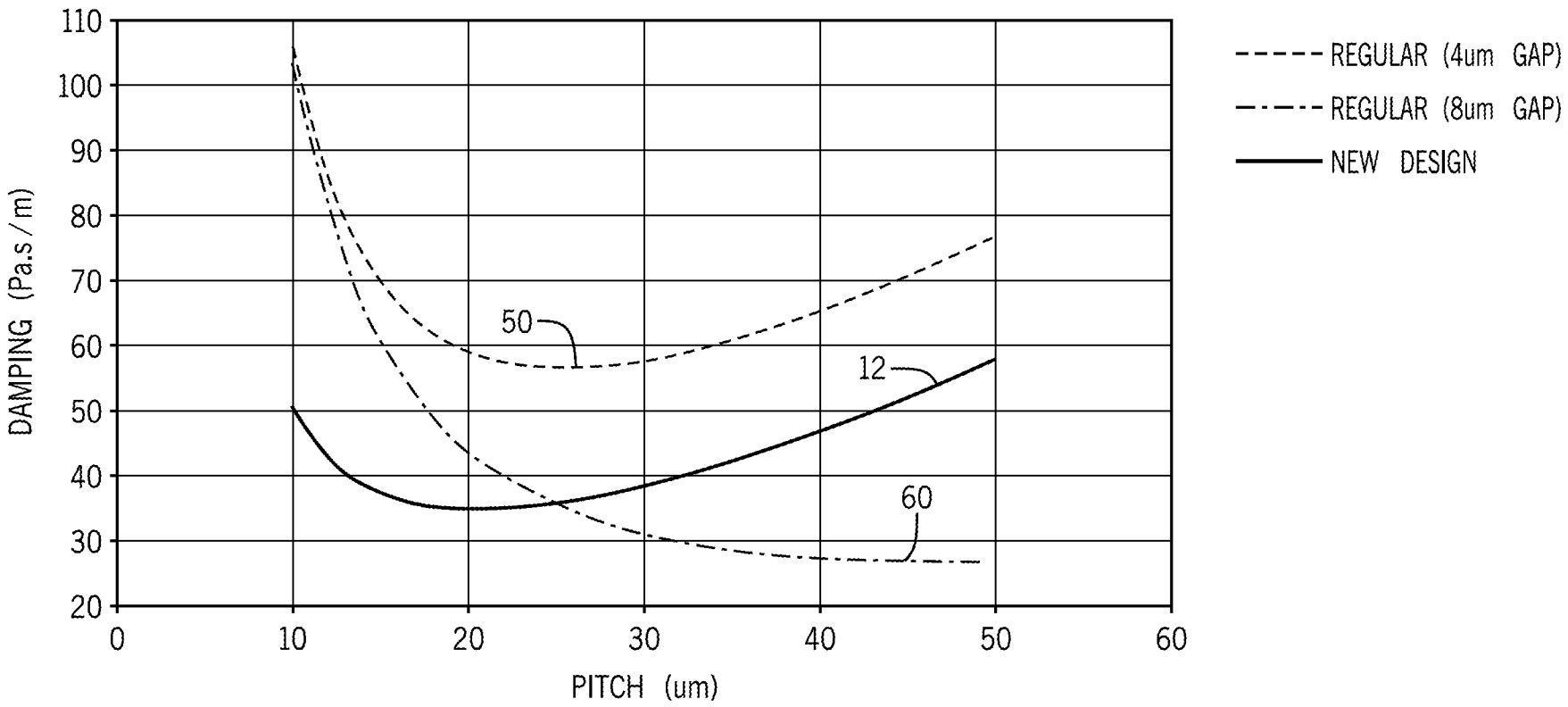
FIG. 5 is a graph showing the damping force coefficient as a function of aperture pitch for three different types of acoustic transducers, according to an illustrative embodiment.
Figure 6:
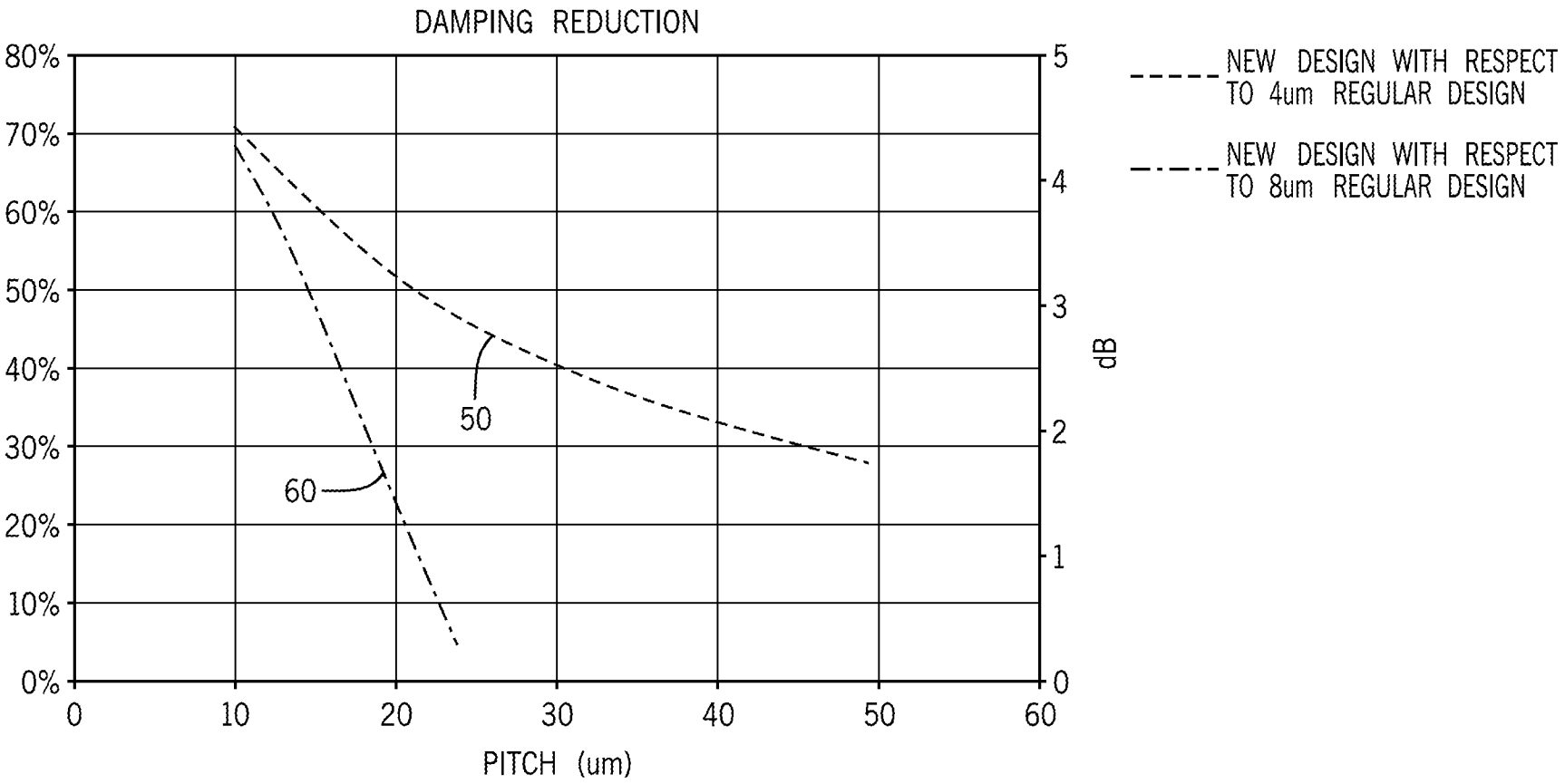
FIG. 6 is a graph showing a reduction in damping as a function of aperture pitch for two different types of single diaphragm acoustic transducers, according to an illustrative embodiment.

FIG. 5 shows the damping force coefficient as a function of the pitch between perforations (e.g., a distance between the primary axis of adjacent perforations) for the transducer 12 of FIGS. 3-4 as compared with two different types of single diaphragm transducers, a first single diaphragm transducer 50 having a gap distance (e.g., between a backplate and a diaphragm) equal to the first distance 240 between the second diaphragm 220 and the back plate 202 of the transducer 12 of FIGS. 3-4, and a second single diaphragm transducer 60 having a gap distance equal to a total distance between the first diaphragm 218 and the back plate 202 of the transducer 12 of FIGS. 3-4. As shown in FIG. 6, at a pitch of approximately 20 microns, damping is reduced for the transducer 12 of FIGS. 3-4 by more than 50% as compared with the first single diaphragm transducer 50 (and by more than 20% as compared with the second single diaphragm transducer 60).

Figure 7:
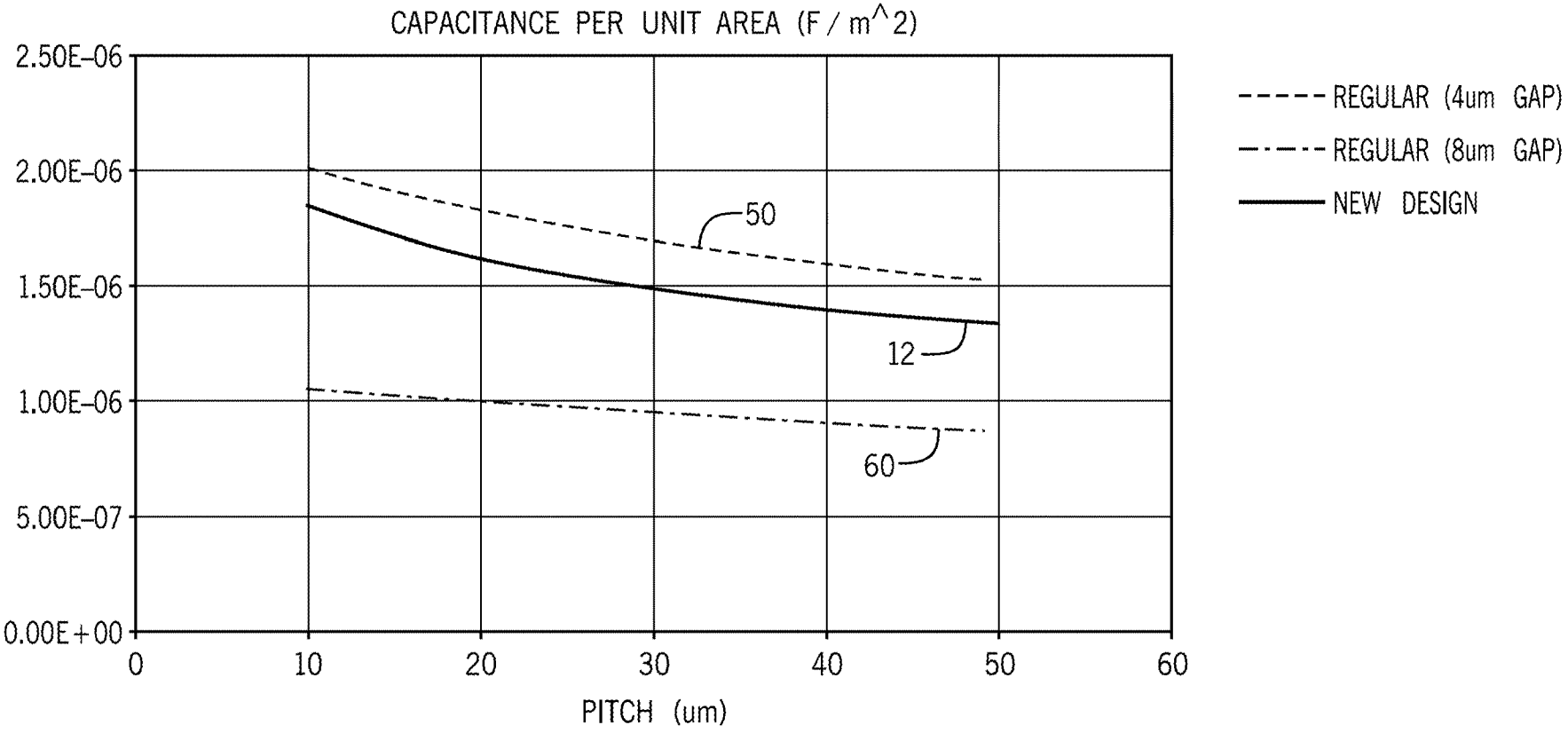
FIG. 7 is a graph showing the capacitance per unit area as a function of aperture pitch for three different types of acoustic transducers, according to an illustrative embodiment.
Figure 8:
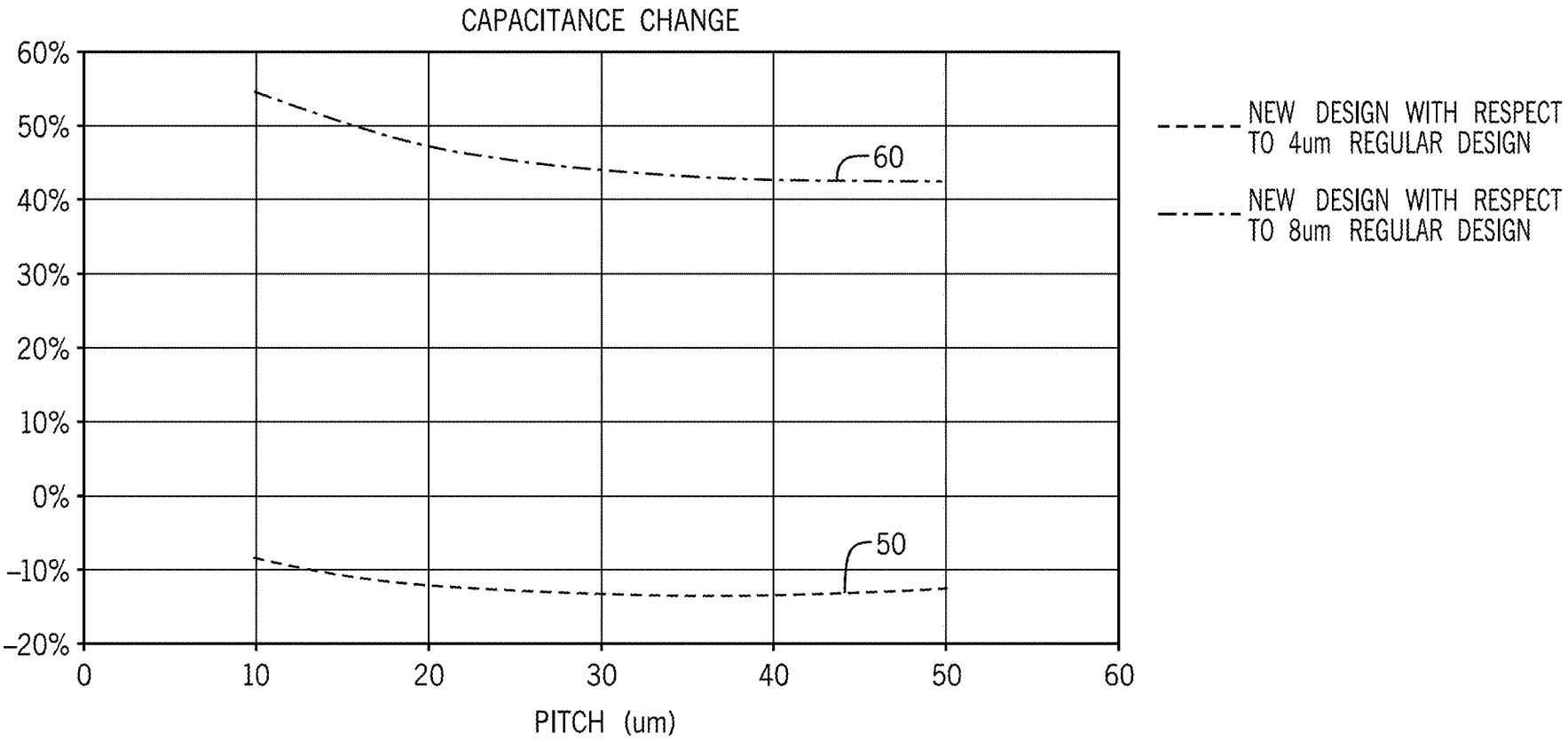
FIG. 8 is a graph showing a percentage reduction in the capacitance per unit area as a function of aperture pitch for two different types of single diaphragm acoustic transducers, according to an illustrative embodiment.

The capacitance per unit area associated with each transducer 12, 50, 60 is shown in FIG. 7. Note that the plurality of diaphragm apertures 228 (see FIG. 3) in the transducer 12 of FIGS. 3-4 reduce the surface area of the conductive layer for the second diaphragm 220, thereby resulting in a slight reduction in the capacitance between the second diaphragm 220 and the back plate 202. However, as shown in FIG. 8, the associated reduction in capacitance is quite small, even when compared with the capacitance of the first single diaphragm transducer 50.

The arrangement of the diaphragm assembly 104, 204 and back plate 102, 202 may vary depending on the design constraints and the desired performance of the transducer 10, 12. By way of example, FIGS. 9-14 show different transducer arrangements, according to various illustrative embodiments.

Figure 9:
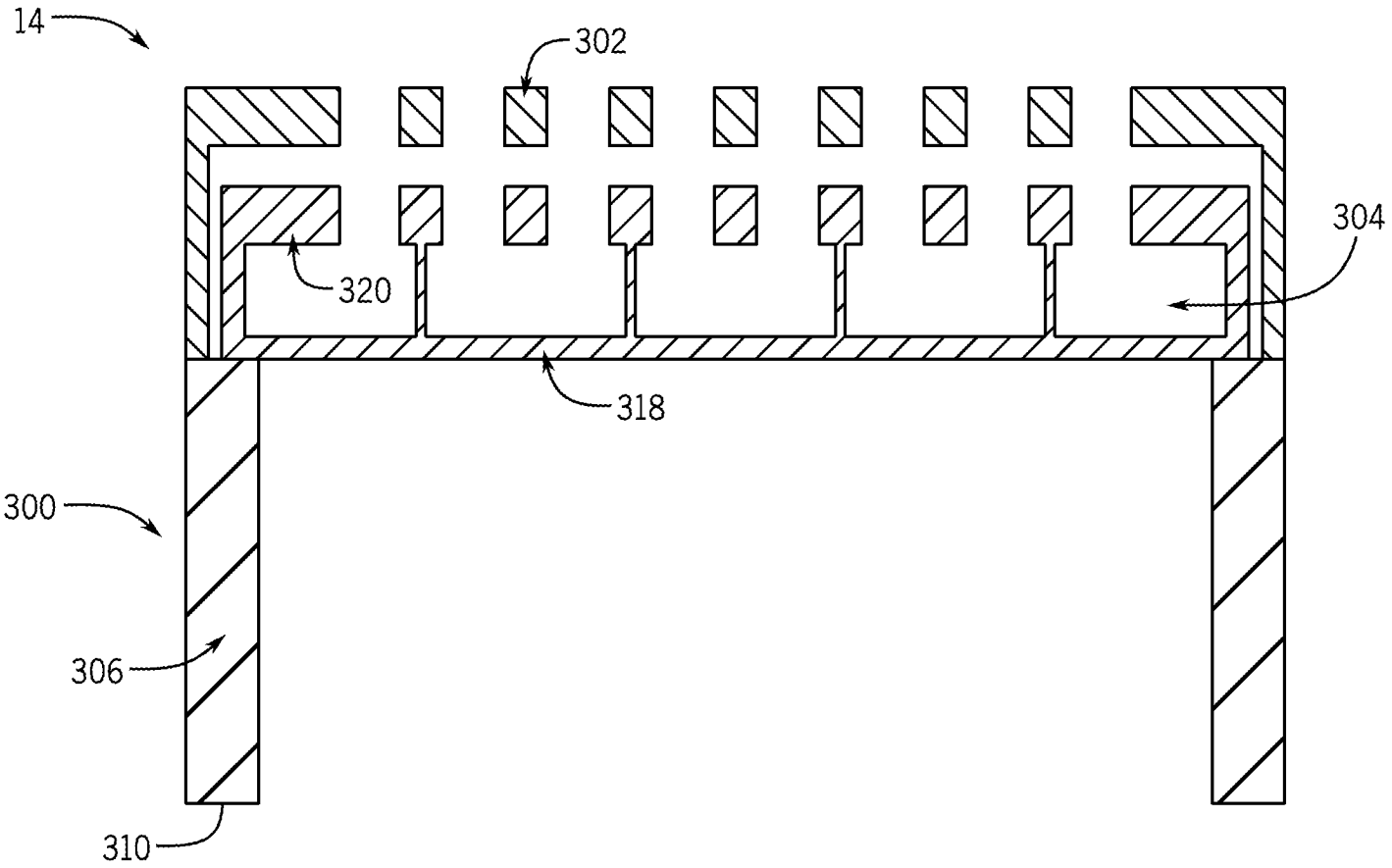
FIG. 9 is a conceptual representation of an acoustic transducer, according to another illustrative embodiment.

In one embodiment, as shown in FIG. 9, a transducer 14 includes a diaphragm assembly 304 including a first diaphragm 318 and a second diaphragm 320. The second diaphragm 320 is coupled to the first diaphragm 318 and also to a transducer substrate 300 of the transducer 14 at a periphery of the second diaphragm 320. Among other benefits, coupling the second diaphragm 320 to the transducer substrate 300 changes the sensitivity of the second diaphragm 320 to incident sound energy. The peripheral coupling may also reduce the risk of particles or other contaminants from being pulled (e.g., sucked, etc.) into any of the gaps between diaphragms 318, 320 and between the diaphragm assembly 304 and a back plate 302 of the transducer 14. In an embodiment, the second diaphragm 320 additionally includes at least one corrugation (e.g., a U-shaped corrugation) disposed proximate to an outer perimeter of the second diaphragm 320 so as to modify a compliance of the diaphragm assembly 304.

Figure 10:
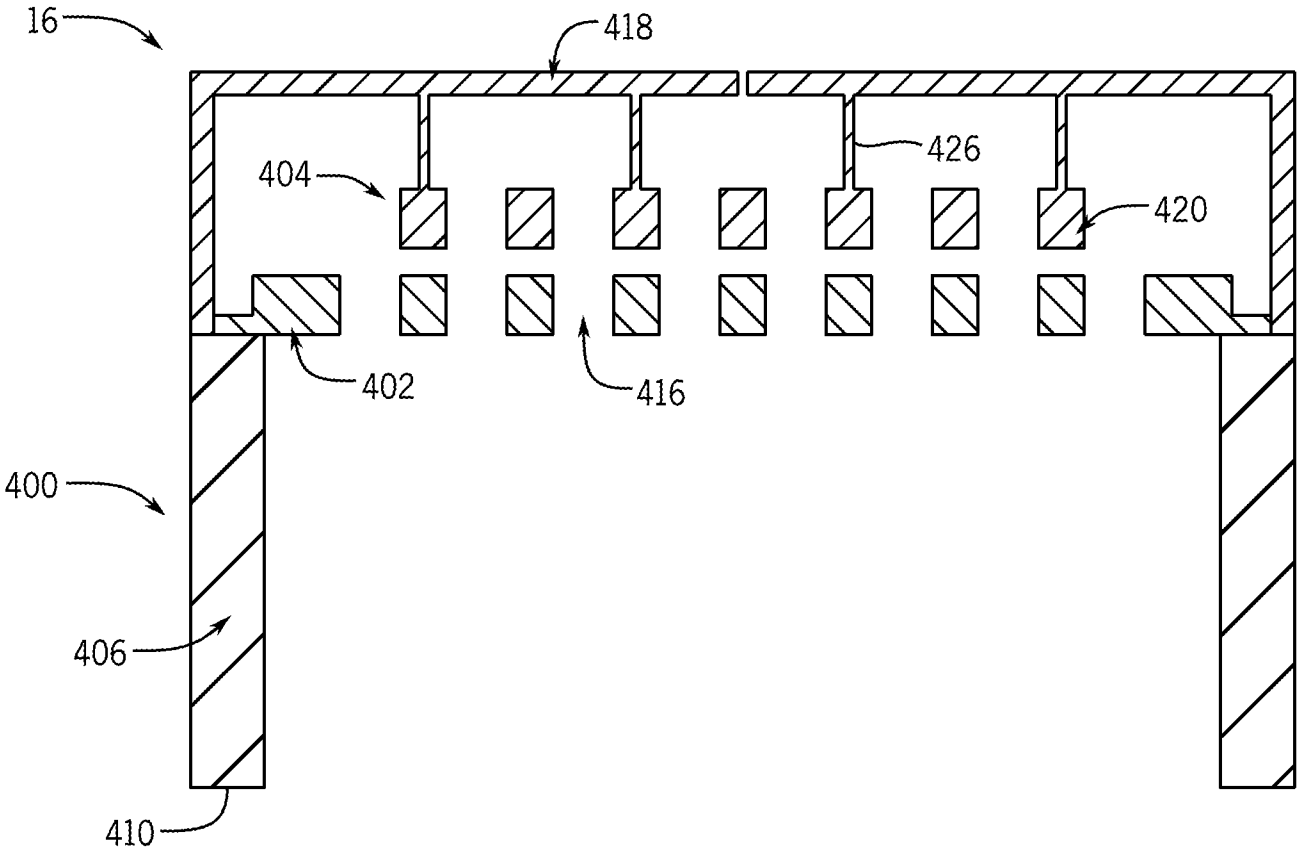
FIG. 10 is a conceptual representation of an acoustic transducer, according to another illustrative embodiment.

In another embodiment, as shown in FIG. 10, the position of the diaphragm assembly 404 and the back plate 402 relative to a transducer substrate 400 may be reversed relative to the transducer 16 of FIG. 9. For example, the back plate 402 may be disposed between the diaphragm assembly 404 and a second end of the transducer substrate 400 (e.g., a second end 410 of a support wall 406 of the transducer substrate 400).

Figure 11:
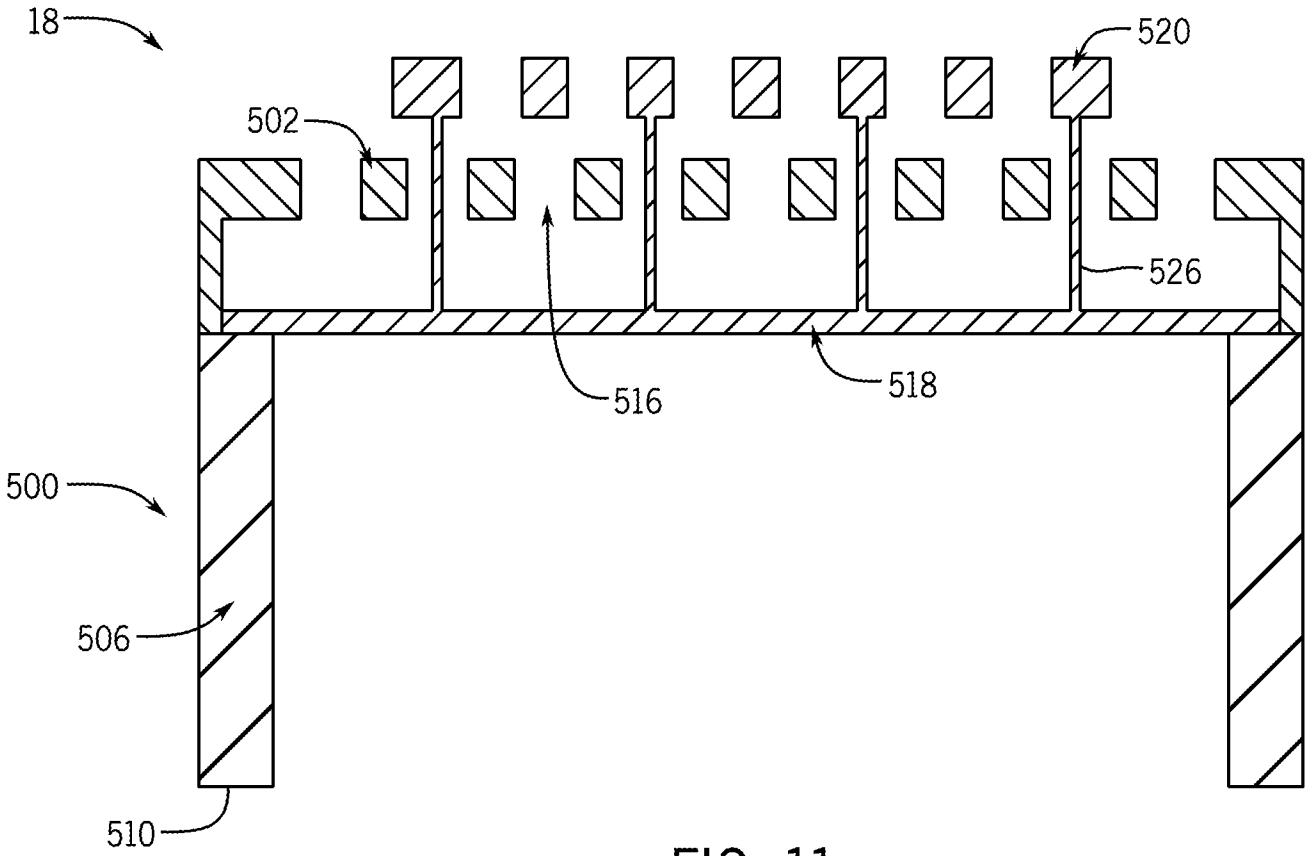
FIG. 11 is a conceptual representation of an acoustic transducer, according to another illustrative embodiment.
Figure 12:
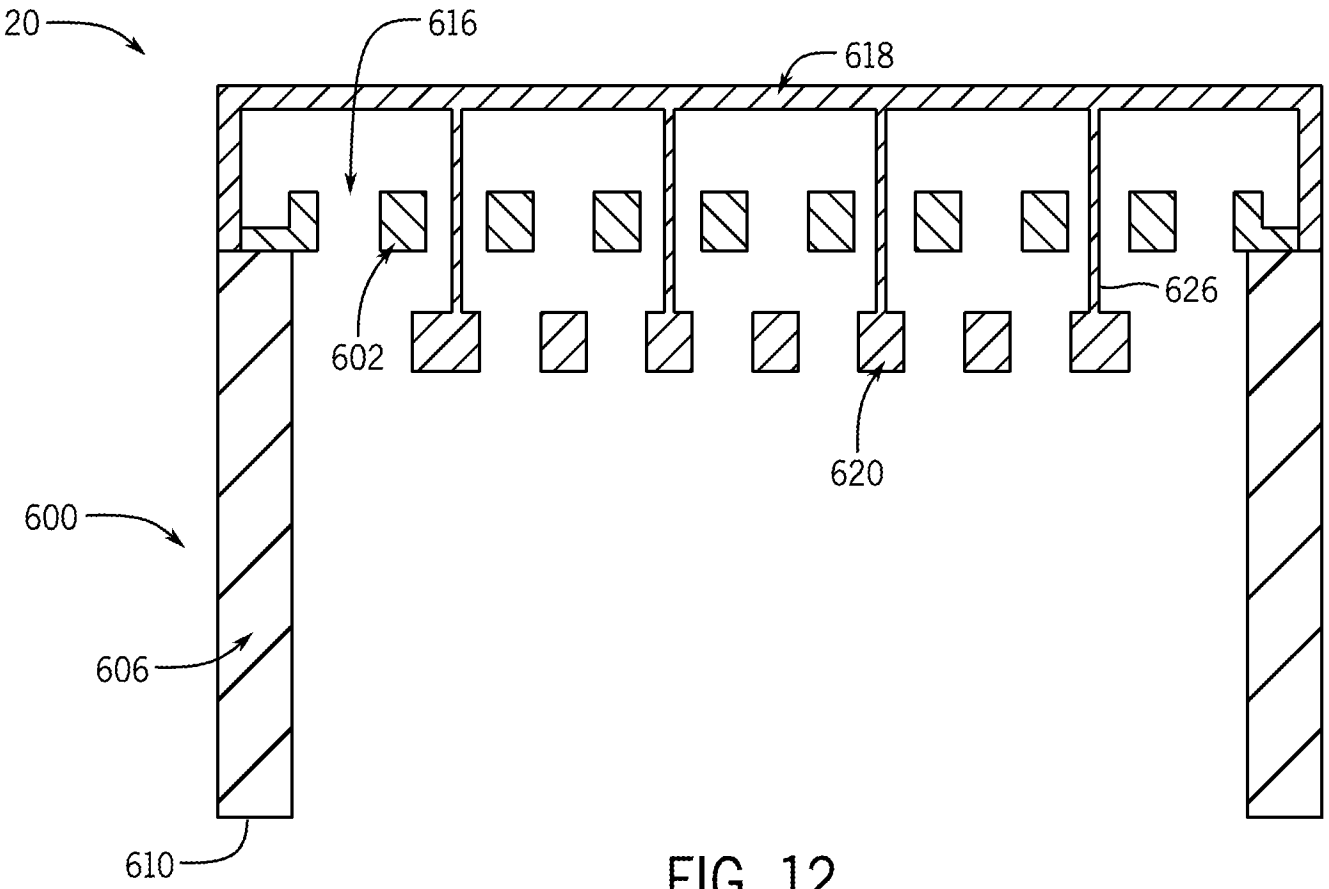
FIG. 12 is a conceptual representation of an acoustic transducer, according to another illustrative embodiment.

In yet other embodiments, as shown in FIGS. 11-12, a transducer 18, 20 may be configured such that a back plate 502, 602 of the transducer 18, 20 is disposed between a first diaphragm 518, 618 of the transducer 18, 20 and a second diaphragm 520, 620 of the transducer 18, 20. The transducers 18, 20 may include a plurality of support members, shown as posts 526, 626 that extend through the back plate 502, 602 (e.g., through a corresponding one of a plurality of apertures 516, 616 of the back plate 502, 602) to couple the first diaphragm 518, 618 to the second diaphragm 520, 620. In the embodiment of FIG. 11, the first diaphragm 518 is disposed between a second end of a transducer substrate 500 for the transducer 18 (e.g., a second end 510 of a support wall 506 of the transducer substrate 500) and the back plate 502. In contrast, in the embodiment of FIG. 12, the second diaphragm 620 is disposed between a second end of a transducer substrate 600 of the transducer 20 (e.g., a second end 610 of a support wall 606 of the transducer substrate 600) and the back plate 602. As with other embodiments described herein, the second diaphragm 520, 620 in each of FIGS. 11-12 is positioned closer to the back plate 502, 602 than the first diaphragm 518, 618, which, advantageously, reduces the contribution to overall damping by the first diaphragm 518, 618. In alternative embodiments, the distance between the second diaphragm 520, 620 and the back plate 502, 602 is greater than or equal to a distance between the first diaphragm 518, 618 and the back plate 502, 602. In this case, perforating the second diaphragm 520, 620 will still result in lower overall damping as compared with a single diaphragm dual diaphragm transducer having similar gap sizes.

Figure 13:
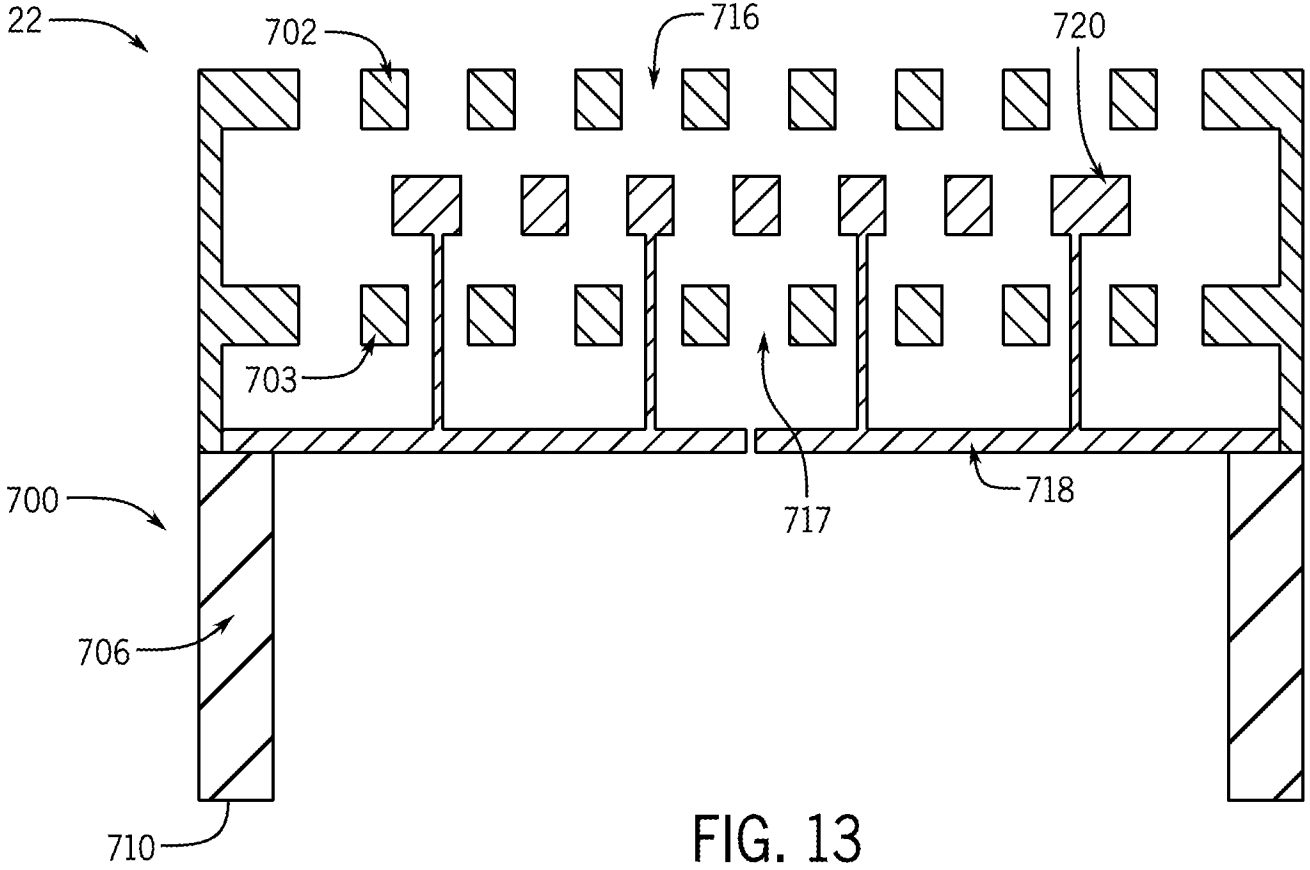
FIG. 13 is a conceptual representation of an acoustic transducer including a pair of back plates, according to an illustrative embodiment.
Figure 14:
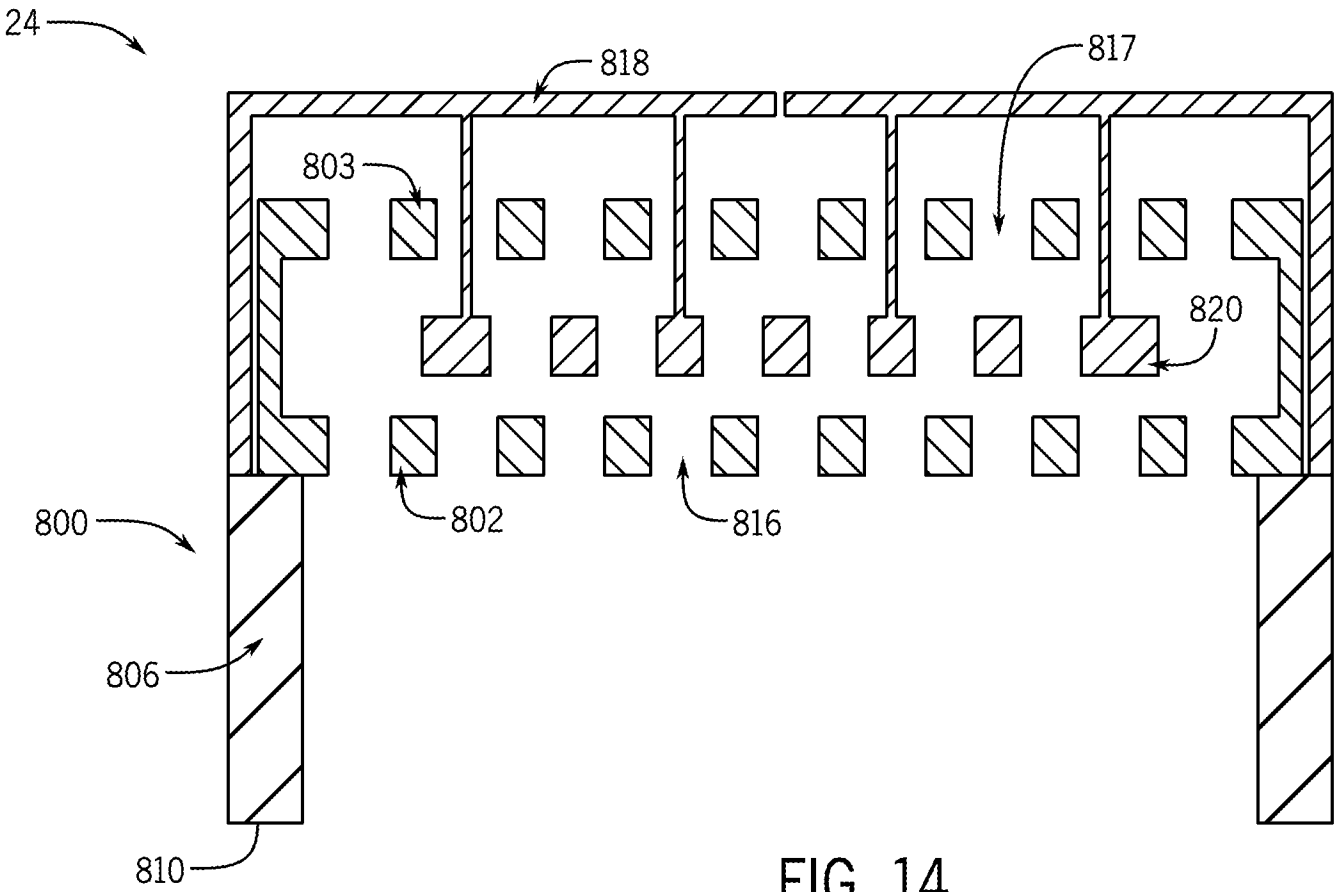
FIG. 14 is a conceptual representation of an acoustic transducer including a pair of back plates, according to another illustrative embodiment.

In yet other embodiments, as shown in FIGS. 13-14, a transducer 22, 24 may include dual back plates, a first back plate 702, 802 defining a first plurality of apertures 716, 816 and a second back plate 703, 803 defining a second plurality of apertures 717, 817. As shown in FIGS. 13-14, each of the transducers 22, 24 is similar to the transducers 18, 20 of FIGS. 11-12, with the exception of the second back plate 703, 803. The second back plate 703, 803 is coupled to a transducer substrate 700, 800 (e.g., coupled to a support wall 706, 806 of the transducer substrate 700, 800) of the transducer 22, 24 proximate to a periphery of the second back plate 703, 803. As shown in FIGS. 13-14, the second diaphragm 720, 820 is disposed between (e.g., sandwiched between, etc.) the first back plate 702, 802 and the second back plate 703, 803. In the embodiments of FIGS. 13-14, the second diaphragm 720, 820 is spaced evenly from the first back plate 702, 802 and the second back plate 703, 803, although in other embodiments the arrangement and/or spacing may be different. As with the embodiment of FIGS. 11-12, the first diaphragm 718, 818 of the transducers 22, 24 of FIGS. 13-14 may be disposed closer to a second end of the transducer substrate 700 (e.g., a second end 710 of the support wall 706) than the first back plate 702 (see FIG. 13), or alternatively separated from the second end of the transducer substrate 800 by the first back plate 802 (see FIG. 14).

Figure 15:
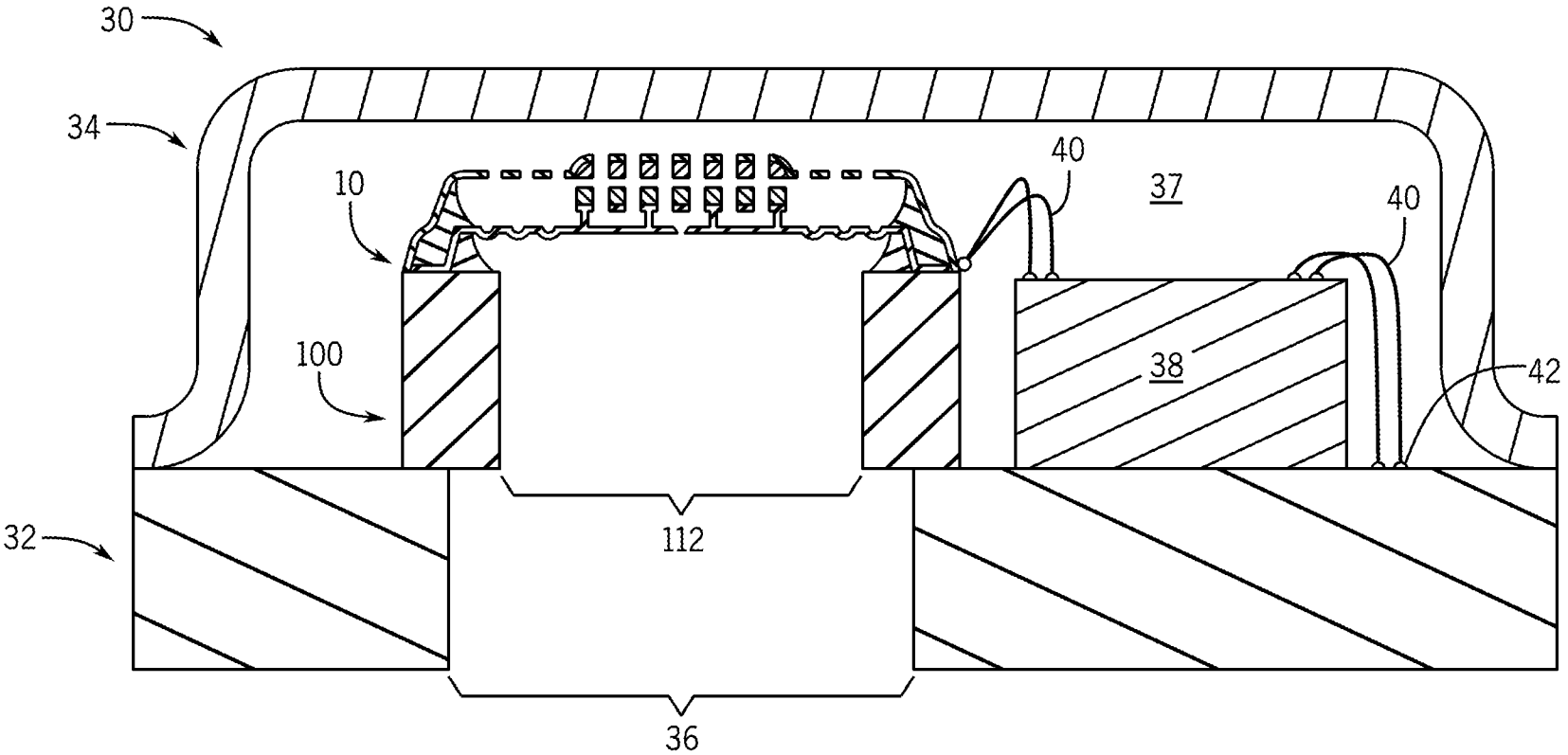
FIG. 15 is a side cross-sectional view of a microphone assembly including the acoustic transducer of FIG. 1, according to an illustrative embodiment.

In an illustrative embodiment, as shown in FIG. 15, the transducer is configured to be received within a microphone assembly, shown as assembly 30. As shown in FIG. 15, the assembly 30 includes a housing including a microphone substrate 32, a cover 34 (e.g., a housing lid), and a sound port 36. The cover 34 may be coupled to the microphone substrate 32 (e.g., the cover 34 may be mounted onto a peripheral edge of the microphone substrate 32). Together, the housing lid 34 and the microphone substrate 32 may form an enclosed volume 37 for the assembly 30. The sound port 36 may be disposed on the microphone substrate 32 and may be configured to convey sound waves to a transducer (e.g., the acoustic transducer 10 of FIGS. 1-2), located within the enclosed volume 37. Alternatively, the sound port 36 may be disposed on the cover 34 or on a side wall of the housing. In some embodiments, the assembly may form part of a compact computing device (e.g., a portable communication device, a smartphone, a smart speaker, an internet of things (IoT) device, etc.), where one, two, three or more assemblies may be integrated for picking-up and processing various types of acoustic signals such as speech and music.

In the embodiment of FIG. 15, the assembly 30 additionally includes an electrical circuit disposed in the enclosed volume 37. The electrical circuit includes an integrated circuit (IC) 38. The IC 38 may be an application specific integrated circuit (ASIC). Alternatively, the IC 38 may include a semiconductor die integrating various analog, analog-to-digital, and/or digital circuits.

As described above, the transducer 10 converts sound waves, received through sound port 36, into a corresponding electrical microphone signal. The transducer 10 generates an electrical signal (e.g., a voltage) at a transducer output in response to acoustic activity incident on the port 36. As shown in FIG. 15, the transducer output includes a pad or terminal of transducer 10 that is electrically connected to the electrical circuit via one or more bonding wires 40. The assembly 30 of FIG. 15 further includes electrical contacts, shown schematically as contacts 42, typically disposed on a bottom surface of the microphone substrate 32. The contacts 42 are electrically coupled to the electrical circuit. The contacts 42 are configured to electrically connect the microphone assembly 30 to one of a variety of host devices.

The acoustic transducer, of which various illustrative embodiments are disclosed herein, provides several advantages over single diaphragm transducers. Among other benefits, the transducer includes a diaphragm assembly including a second diaphragm configured to interact with a back plate so as to generate an electrical signal in response to acoustic activity (e.g., sound energy) incident on the diaphragm assembly. The second diaphragm defines a plurality of perforations or diaphragm apertures, which allow air to pass through the second diaphragm, thereby reducing a source of damping associated with movement of the second diaphragm relative to the back plate. Additionally, the second diaphragm is coupled to the first diaphragm so as to coordinate movement between the diaphragms. Since the diaphragms move together, damping between the two diaphragms is effectively eliminated. The electrical signal is based on the interaction between the back plate and the second diaphragm; hence, the reduction in capacitance associated with using a perforated diaphragm as compared to a single diaphragm transducer is minimized.

The herein described subject matter sometimes illustrates different components contained within, or connected with, different other components. It is to be understood that such depicted architectures are illustrative, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality, and any two components capable of being so associated can also be viewed as being "operably couplable," to each other to achieve the desired functionality. Specific examples of operably couplable include but are not limited to physically mateable and/or physically interacting components and/or wirelessly interactable and/or wirelessly interacting components and/or logically interacting and/or logically interactable components.

With respect to the use of plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.).

Although the figures and description may illustrate a specific order of method steps, the order of such steps may differ from what is depicted and described, unless specified differently above. Also, two or more steps may be performed concurrently or with partial concurrence, unless specified differently above. Such variation may depend, for example, on the software and hardware systems chosen and on designer choice. All such variations are within the scope of the disclosure. Likewise, software implementations of the described methods could be accomplished with standard programming techniques with rule-based logic and other logic to accomplish the various connection steps, processing steps, comparison steps, and decision steps.

It will be further understood by those within the art that if a specific number of an introduced claim recitation is intended, such an intent will be explicitly recited in the claim, and in the absence of such recitation, no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations).

Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general, such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

Further, unless otherwise noted, the use of the words "approximate," "about," "around," "substantially," etc., mean plus or minus ten percent.

The foregoing description of illustrative embodiments has been presented for purposes of illustration and of description. It is not intended to be exhaustive or limiting with respect to the precise form disclosed, and modifications and variations are possible in light of the above teachings or may be acquired from practice of the disclosed embodiments. It is intended that the scope of the invention be defined by the claims appended hereto and their equivalents.

What is claimed is:

1. An acoustic transducer for generating electrical signals in response to acoustic signals comprising:

a back plate defining a plurality of apertures; and a diaphragm assembly comprising:

a first diaphragm oriented substantially parallel to the back plate and offset from the back plate such that a cavity is formed therebetween, the first diaphragm defining a single diaphragm aperture; and a second diaphragm oriented substantially parallel to the back plate and offset from the back plate, the second diaphragm positioned a distance from the back plate that is less than a distance between the first diaphragm and the back plate, the second diaphragm coupled to the first diaphragm, the second diaphragm defining a plurality of diaphragm apertures.

2. The acoustic transducer of claim 1, further comprising a transducer substrate including a first end and a second end, wherein the back plate, the first diaphragm, and the second diaphragm are disposed proximate to the first end, and wherein the back plate and the first diaphragm are coupled to the transducer substrate at their periphery.

3. An acoustic transducer for generating electrical signals in response to acoustic signals comprising:

a back plate defining a plurality of apertures;

a diaphragm assembly comprising:

a first diaphragm oriented substantially parallel to the back plate and offset from the back plate such that a cavity is formed therebetween; and a second diaphragm oriented substantially parallel to the back plate and offset from the back plate, the second diaphragm positioned a distance from the back plate that is less than a distance between the first diaphragm and the back plate, the second diaphragm coupled to the first diaphragm, the second diaphragm defining a plurality of diaphragm apertures, and a transducer substrate including a first end and a second end, wherein the back plate, the first diaphragm, and the second diaphragm are disposed proximate to the first end, wherein the back plate and the first diaphragm are coupled to the transducer substrate at their periphery, wherein the diaphragm assembly is disposed between the back plate and the second end of the transducer substrate, wherein the second diaphragm is disposed in the cavity between the first diaphragm and the back plate.

4. The acoustic transducer of claim 3, wherein the second diaphragm is coupled to the transducer substrate at a periphery of the second diaphragm.

5. An acoustic transducer for generating electrical signals in response to acoustic signals comprising:

a back plate defining a plurality of apertures;

a diaphragm assembly comprising:

a first diaphragm oriented substantially parallel to the back plate and offset from the back plate such that a cavity is formed therebetween; and a second diaphragm oriented substantially parallel to the back plate and offset from the back plate, the second diaphragm positioned a distance from the back plate that is less than a distance between the first diaphragm and the back plate, the second diaphragm coupled to the first diaphragm, the second diaphragm defining a plurality of diaphragm apertures, and a transducer substrate including a first end and a second end, wherein the back plate, the first diaphragm, and the second diaphragm are disposed proximate to the first end, wherein the back plate and the first diaphragm are coupled to the transducer substrate at their periphery, wherein the back plate is disposed between the diaphragm assembly and the second end of the transducer substrate, wherein the second diaphragm is disposed in the cavity between the first diaphragm and the back plate.

6. The acoustic transducer of claim 5, wherein the second diaphragm is coupled to the transducer substrate at a periphery of the second diaphragm.

7. An acoustic transducer for generating electrical signals in response to acoustic signals comprising:

a back plate defining a plurality of apertures;

a diaphragm assembly comprising:

a first diaphragm oriented substantially parallel to the back plate and offset from the back plate such that a cavity is formed therebetween; and a second diaphragm oriented substantially parallel to the back plate and offset from the back plate, the second diaphragm positioned a distance from the back plate that is less than a distance between the first diaphragm and the back plate, the second diaphragm coupled to the first diaphragm, the second diaphragm defining a plurality of diaphragm apertures, and a transducer substrate including a first end and a second end, wherein the back plate, the first diaphragm, and the second diaphragm are disposed proximate to the first end, wherein the back plate and the first diaphragm are coupled to the transducer substrate at their periphery, wherein the back plate is disposed between the first diaphragm and the second diaphragm, and wherein the first diaphragm is disposed between the second end of the transducer substrate and the back plate.

8. An acoustic transducer for generating electrical signals in response to acoustic signals comprising:

a back plate defining a plurality of apertures;

a diaphragm assembly comprising:

a first diaphragm oriented substantially parallel to the back plate and offset from the back plate such that a cavity is formed therebetween; and a second diaphragm oriented substantially parallel to the back plate and offset from the back plate, the second diaphragm positioned a distance from the back plate that is less than a distance between the first diaphragm and the back plate, the second diaphragm coupled to the first diaphragm, the second diaphragm defining a plurality of diaphragm apertures, and a transducer substrate including a first end and a second end, wherein the back plate, the first diaphragm, and the second diaphragm are disposed proximate to the first end, wherein the back plate and the first diaphragm are coupled to the transducer substrate at their periphery, wherein the back plate is disposed between the first diaphragm and the second diaphragm, and wherein the second diaphragm is disposed between the second end of the transducer substrate and the back plate.

9. An acoustic transducer for generating electrical signals in response to acoustic signals comprising:

a back plate defining a plurality of apertures;

a diaphragm assembly comprising:

a first diaphragm oriented substantially parallel to the back plate and offset from the back plate such that a cavity is formed therebetween; and a second diaphragm oriented substantially parallel to the back plate and offset from the back plate, the second diaphragm positioned a distance from the back plate that is less than a distance between the first diaphragm and the back plate, the second diaphragm coupled to the first diaphragm, the second diaphragm defining a plurality of diaphragm apertures, and a post extending from the first diaphragm towards the second diaphragm, the post coupled to both the first diaphragm and the second diaphragm and configured to prevent movement of the second diaphragm relative to the first diaphragm in a direction substantially perpendicular to the second diaphragm, wherein the back plate is disposed between the first diaphragm and the second diaphragm, wherein the post extends through an individual one of the plurality of apertures.

10. An acoustic transducer for generating electrical signals in response to acoustic signals comprising:

a back plate defining a plurality of apertures; and a diaphragm assembly comprising:

a first diaphragm oriented substantially parallel to the back plate and offset from the back plate such that a cavity is formed therebetween; and a second diaphragm oriented substantially parallel to the back plate and offset from the back plate, the second diaphragm positioned a distance from the back plate that is less than a distance between the first diaphragm and the back plate, the second diaphragm coupled to the first diaphragm, the second diaphragm defining a plurality of diaphragm apertures, wherein a first distance between the second diaphragm and the first back plate is greater than a second distance between the second diaphragm and the first diaphragm.

11. The acoustic transducer of claim 10, wherein the first distance is approximately two times the second distance.

12. An acoustic transducer for generating electrical signals in response to acoustic signals comprising:

a back plate defining a plurality of apertures; and a diaphragm assembly comprising:

a first diaphragm oriented substantially parallel to the back plate and offset from the back plate such that a cavity is formed therebetween; and a second diaphragm oriented substantially parallel to the back plate and offset from the back plate, the second diaphragm positioned a distance from the back plate that is less than a distance between the first diaphragm and the back plate, the second diaphragm coupled to the first diaphragm, the second diaphragm defining a plurality of diaphragm apertures, wherein the plurality of diaphragm apertures is misaligned with the plurality of apertures in the back plate such that the plurality of apertures in the back plate is at least partially occluded by the second diaphragm in a direction substantially perpendicular to the back plate.

13. An acoustic transducer for generating electrical signals in response to acoustic signals comprising:

a back plate defining a plurality of apertures; and a diaphragm assembly comprising:

a first diaphragm oriented substantially parallel to the back plate and offset from the back plate such that a cavity is formed therebetween; and a second diaphragm oriented substantially parallel to the back plate and offset from the back plate, the second diaphragm positioned a distance from the back plate that is less than a distance between the first diaphragm and the back plate, the second diaphragm coupled to the first diaphragm, the second diaphragm defining a plurality of diaphragm apertures, wherein a distance between a primary axis of adjacent ones of the plurality of apertures is approximately equal to a distance between a primary axis of adjacent ones of the plurality of diaphragm apertures.

14. An acoustic transducer for generating electrical signals in response to acoustic signals comprising:

a first back plate defining a first plurality of apertures;

a second back plate oriented substantially parallel to the first back plate and offset from the first back plate such that a cavity is formed therebetween, the second back plate defining a second plurality of apertures;

a diaphragm assembly comprising:

a first diaphragm oriented substantially parallel to the first back plate and offset from the first back plate and the cavity between the first back plate and the second back plate; and a second diaphragm oriented substantially parallel to the first back plate, the second diaphragm disposed in the cavity between the first back plate and the second back plate, the second diaphragm coupled to the first diaphragm, the second diaphragm defining a plurality of diaphragm apertures; and a transducer substrate defining an aperture, the transducer substrate including a first end and a second end, wherein the first back plate, the second back plate, the first diaphragm, and the second diaphragm are disposed proximate to the first end, and wherein the first back plate, the second back plate, and the first diaphragm are coupled to the transducer substrate at their periphery.

15. The acoustic transducer of claim 14, the first diaphragm disposed between the first back plate and the second end of the transducer substrate.

16. An acoustic transducer for generating electrical signals in response to acoustic signals comprising:

a first back plate defining a first plurality of apertures;

a second back plate oriented substantially parallel to the first back plate and offset from the first back plate such that a cavity is formed therebetween, the second back plate defining a second plurality of apertures;

a diaphragm assembly comprising:

a first diaphragm oriented substantially parallel to the first back plate and offset from the first back plate and the cavity between the first back plate and the second back plate; and a second diaphragm oriented substantially parallel to the first back plate, the second diaphragm disposed in the cavity between the first back plate and the second back plate, the second diaphragm coupled to the first diaphragm, the second diaphragm defining a plurality of diaphragm apertures, the first back plate disposed between the first diaphragm and the second end of the transducer substrate.

* * * * *